US005115538A

United States Patent [19]

Cochran et al.

[11] Patent Number: 5,115,538

[45] Date of Patent: May 26, 1992

[54] VACUUM CLEANERS

[75] Inventors: John R. Cochran, Baltimore, Md.; Rouse R. Bailey, Jr., New Park, Pa.; William R. Lessig, III, Hunt Valley, Md.

[73] Assignee: Black & Decker Inc., Newark, Del.

[21] Appl. No.: 692,645

[22] Filed: Apr. 29, 1991

Related U.S. Application Data

[62] Division of Ser. No. 469,176, Jan. 24, 1990, Pat. No. 5,020,186.

[51] Int. Cl.[5] ..... A47L 9/04

[52] U.S. Cl. ..... 15/383; 15/415.1; 15/419

[58] Field of Search ..... 15/415.1, 419, 392, 15/366, 374, 383, 384, 41.1, 49.1

[56] References Cited

U.S. PATENT DOCUMENTS

| | | | |
|---|---|---|---|
| 1,946,585 | 2/1934 | Leathers . | |
| 2,668,315 | 2/1954 | Crosby . | |
| 3,150,394 | 9/1964 | Sauers | 15/384 X |
| 3,184,775 | 5/1965 | Downey et al. | 15/DIG. 1 |
| 3,188,681 | 6/1965 | Jepson et al. | 15/35 X |
| 3,377,647 | 4/1968 | Hill et al. . | |
| 3,524,213 | 6/1968 | Spivack . | |
| 3,634,905 | 1/1972 | Boyd | 15/350 |
| 3,780,398 | 12/1973 | Candor | 15/415.1 |
| 4,209,875 | 7/1980 | Pugh et al. . | |
| 4,357,730 | 11/1982 | Lex . | |
| 4,361,929 | 12/1982 | Jinkins . | |
| 4,416,034 | 11/1983 | Ahlf et al. | 15/419 X |
| 4,445,245 | 5/1984 | Lu . | |
| 4,499,628 | 2/1985 | Platt | 15/419 |
| 4,553,284 | 11/1985 | Strumbos | 15/415.1 X |
| 4,835,409 | 4/1989 | Bhagwat et al. | 15/DIG. 1 |
| 4,837,888 | 6/1989 | Maier | 15/415.1 X |
| 4,841,594 | 6/1989 | Elson et al. . | |

FOREIGN PATENT DOCUMENTS

| | | | |
|---|---|---|---|
| 1198142 | 6/1959 | France | 15/383 |
| 286622 | 6/1931 | Italy . | |

OTHER PUBLICATIONS

Appliance Manufacturer—Jul., 1989 issue, p. 46.

Oct. 23, 1989 issue of Design News, p. 87 Dustbuster Plus Power Brush, 5 photos.

*Primary Examiner*—Chris K. Moore

*Attorney, Agent, or Firm*—Dennis A. Dearing; Charles E. Yocum; Edward D. C. Bartlett

[57] ABSTRACT

A vacuum cleaner has a power brush which projects dirt particles directly into a specially formed and located vacuum nozzle in such a manner that low air consumption can be used. The vacuum nozzle has an inlet extending along the full axial length of the power brush. Inclined grooming brushes may be provided to eliminate wheel tracks. The front wall forwardly of the power brush may be modified to provide front edge cleaning. A cordless upright vacuum cleaner may advantageously be provided having a cleaning performance comparable with that of mains powered upright cleaners.

20 Claims, 8 Drawing Sheets

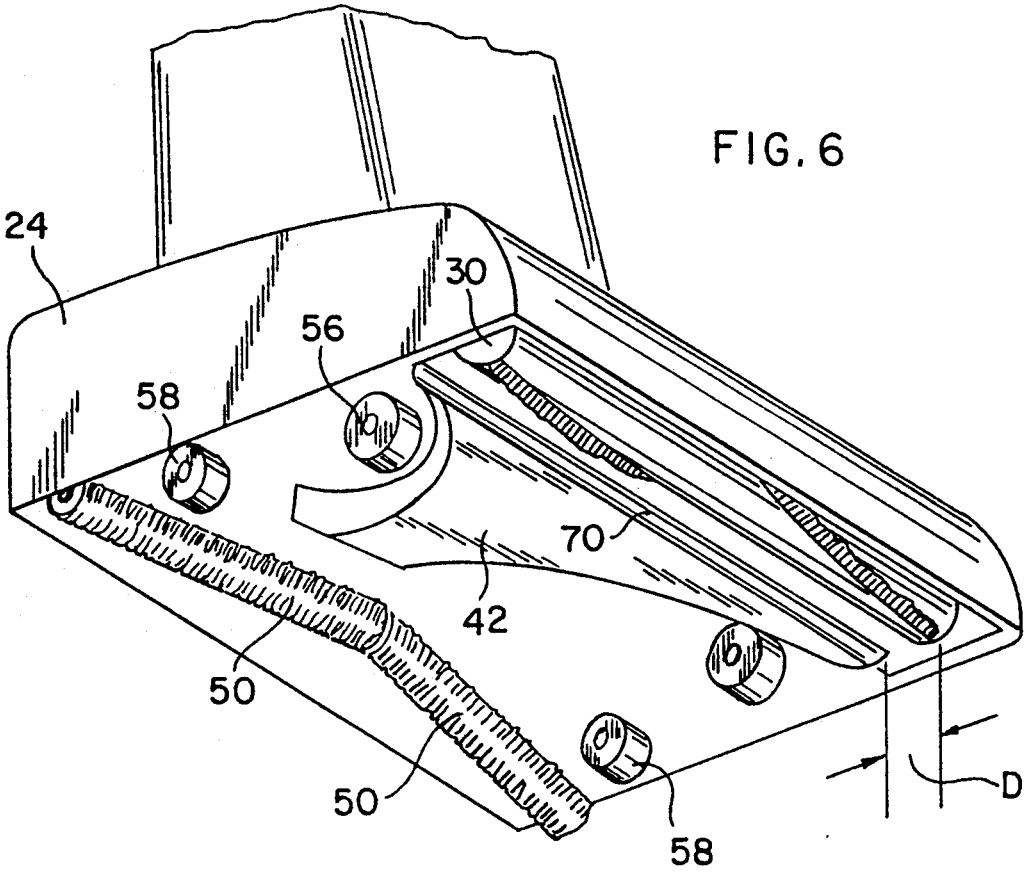
FIG. 6
FIG. 9
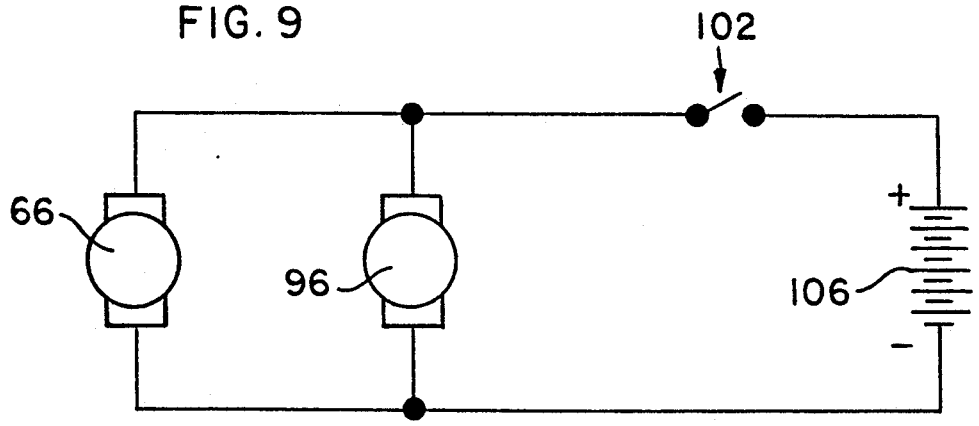

FIG. 7
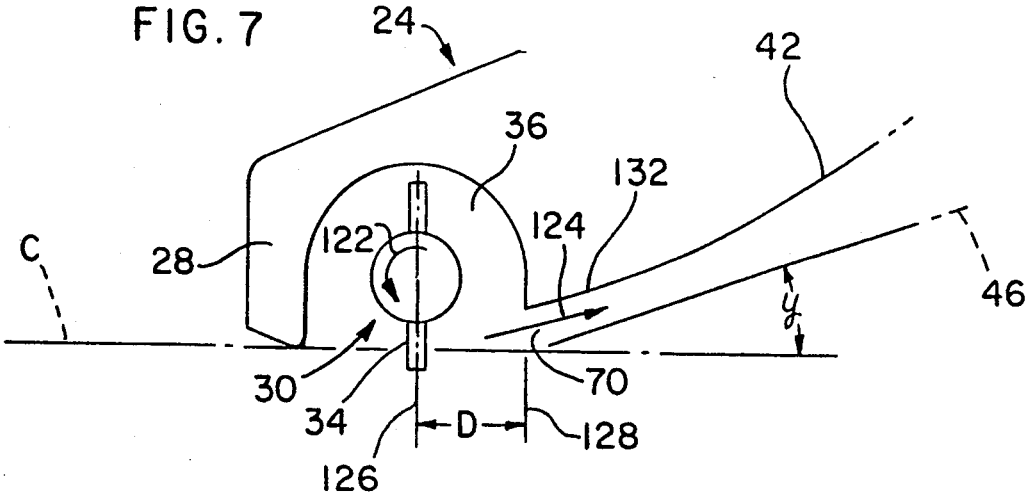
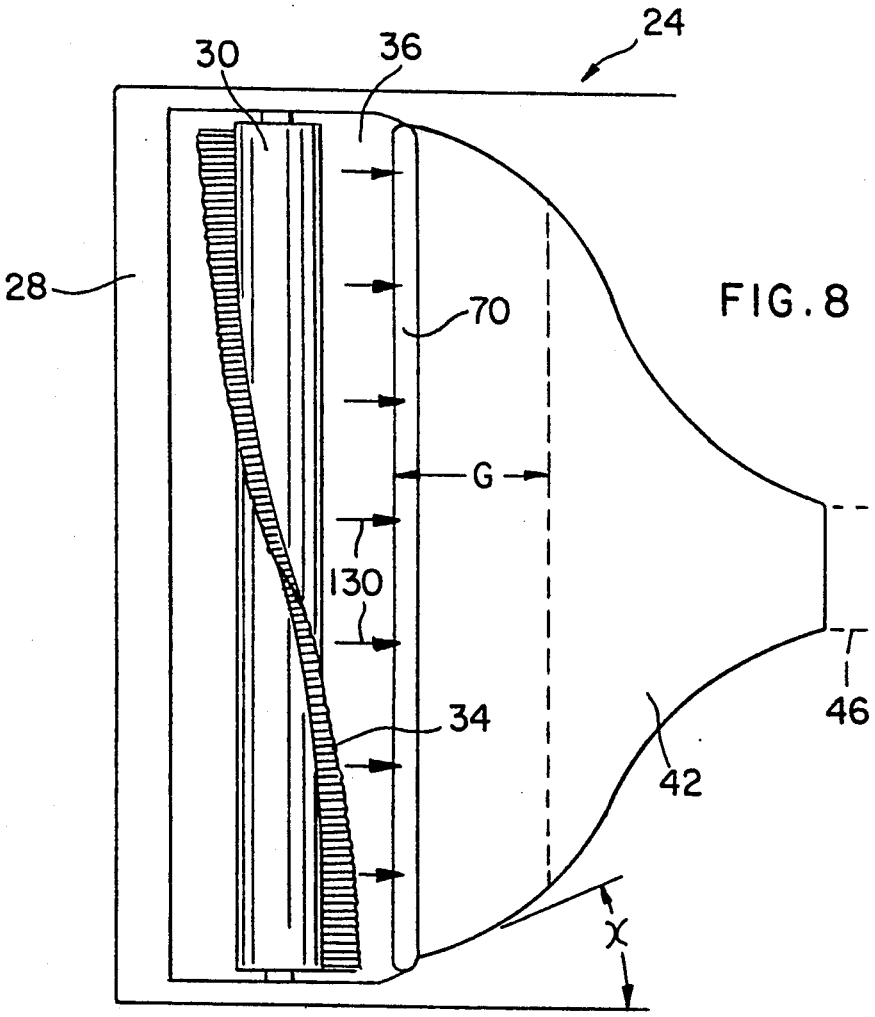
FIG. 8

VACUUM CLEANERS

CROSS REFERENCE TO RELATED APPLICATION

This is a divisional application of copending application Ser. No. 469,176 filed Jan. 24, 1990, now U.S. Pat. No. 5,020,186 issued Jun. 4, 1991.

FIELD OF THE INVENTION

This invention relates to vacuum cleaners in general. It is particularly applicable to upright vacuum cleaners, and has special application to cordless upright vacuum cleaners.

BACKGROUND OF THE INVENTION

There are various types of vacuum cleaners, for example, upright models, so called cylinder models, upholstery cleaners, handheld convenience models, etc. Many of these are corded and powered from a remote electrical source of power, e.g. house mains supply. Some are battery operated, i.e. cordless. Different models consume different levels of power depending, inter alia, on size, type, purpose etc. However, in general, corded vacuum cleaners are considerably more powerful and effective than cordless models.

Even though vacuum cleaners have been continually developed and improved for over 50 years, there are still deficiencies in many and room for further improvement, such as, for example, in the areas of performance, power consumption, cost to manufacture, etc. This applies to both corded and cordless vacuum cleaners, but is particularly applicable to cordless models.

SUMMARY OF THE INVENTION

The present invention is, in general, concerned with improving the performance of vacuum cleaners and/or reducing the power consumption used for a particular performance.

According to one aspect of the invention, a vacuum cleaner has a body with a handle, the body containing a vacuum nozzle and a brush rotatable about an axis parallel in use to a surface to be cleaned. The nozzle has an inlet extending parallel to the brush axis and is spaced from but adjacent the brush, the inlet extending for the length of the brush along its axis, being directed towards the brush, and being adjacent the surface to be cleaned. The nozzle has an air passageway communicating with and extending from the inlet, after at most an initial section adjacent the inlet the passageway having a constant cross-sectional area. It also has means for rotating the brush about its axis to sweep dirt directly from the surface being cleaned to and through the inlet into the passageway, and means for sucking air through the inlet and the passageway.

The initial section may increase in cross-sectional area from the constant cross-sectional area of the passageway to the inlet. This advantageously allows larger objects to be picked-up, e.g. cigarette ends, while maintaining an overall good air speed through the passageway as a whole.

A dust container may be disposed in a casing or housing pivotally connected to a base containing the brush, the handle being connected to and extending upwardly from this casing or housing.

The vacuum cleaner may be cordless and include a rechargeable battery for powering the air sucking means and/or the brush rotating means.

Preferably, the inlet has a cross-sectional area which does not cause the air speed to drop below 500 feet per minute (152 meters per minute), for example not greater than five times the constant cross-sectional area of the passageway. Along an initial part of the vacuum nozzle, where the air velocity is low, the nozzle preferably is inclined upwardly in the downstream direction at an angle of 20 degrees or less, and the nozzle side walls preferably incline inwards at an angle of 45 degrees or less.

Preferably, the air sucking means draws air through the constant cross-sectional area of the passageway at an air velocity of about or at least 2,000 feet per minute (610 meters per minute), with the air being drawn through the inlet at an air velocity of at least one fifth thereof, for example one quarter thereof.

Advantageously, the brush may have only bristles extending therefrom, and these bristles impart kinetic energy to the swept dirt to propel this dirt through the initial section of the passageway.

For improved edge cleaning, the brush may be disposed immediately adjacent but rearwardly of a front wall of the body, this front wall being resiliently yieldable rearwardly to enable the brush to sweep the edge of the surface abutting a room wall when the front wall is pushed against this room wall.

According to another aspect of the present invention, there is provided a vacuum cleaner for cleaning carpet, comprising a base having a handle connected thereto for manipulating the vacuum cleaner over the carpet, means for collecting dust and dirt, a power rotated brush disposed in the base for sweeping the carpet, the brush being rotated about an axis parallel to the surface of the carpet, a vacuum nozzle located adjacent the brush and connected to the collecting means, the brush sweeping dust and dirt from the carpet in a discharge direction directly towards an inlet of the nozzle, means for sucking air through the inlet to convey swept dust and dirt into the collecting means, and power rotation of the brush vibrating the carpet and producing a theoretical location of maximum amplitude of carpet vibrations spaced from the axis in the discharge direction, the inlet being spaced in the discharge direction from this theoretical location.

This theoretical location is spaced a distance d from a line of contact of the brush with the carpet directly beneath said axis, and preferably the inlet is spaced a distance D equal to at least 2d from such line of contact. The inlet may advantageously be spaced a distance in the range 2d to 3d from such line of contact.

According to yet another aspect of the present invention, there is provided a cordless vacuum cleaner having a handle connected to a body for pushing the body in a forward direction over a surface to be cleaned and for pulling the body in a rearward direction over the surface. The body contains a power driven brush rotatable about an axis parallel to the surface to be cleaned with a vacuum nozzle located adjacent the brush, and the brush being disposed immediately adjacent but rearwardly of, a front wall of the body. The front wall is resiliently yieldable rearwardly when the body is pressed forwardly against a room wall to enable the brush to contact and sweep the surface to be cleaned at an edge location thereof abutting the room wall.

Advantageously, the front wall may comprise a deformable skirt connected along an upper edge to the vacuum cleaner body and having a free lower edge. However, the front wall may comprise a movable element which is biased to normally extend forwardly over the brush, but on being pressed forwardly against the room wall retracts relative to the body to expose the brush to the room wall.

According to yet a further aspect of the present invention, there is provided a vacuum cleaner comprising a body containing a power driven brush having bristles, means connected to the body for pushing the body forwardly and pulling the body rearwardly over a surface to be cleaned, the body having a front wall which is normally spaced from and extends downwardly over a front portion of the brush, and the front wall being resiliently yieldable rearwardly relative to the body when the body is pushed forwardly against a room wall to expose the brush at a junction of the wall with the surface and enable the bristles to sweep the junction to remove dirt therefrom.

Preferably, upon rearward yielding of the front wall the bristles contact and sweep down a bottom part of the room wall at the junction.

According to a further aspect of the invention, there is provided a vacuum cleaner comprising a body with a handle connected thereto for manipulating the body in a forward and rearward direction over a surface to be cleaned, the body containing a power rotated brush arrangement, a grooming brush arrangement, and a vacuum nozzle. Wheels support the body for movement over the surface. The power brush arrangement extends transversely across the body at one end thereof, and the grooming brush arrangement extends transversely across the body at an opposite end thereof. The wheels are disposed between the power brush and the grooming brush arrangements in the forward and rearward direction, and the wheels are located transversely inwards of transversely outermost ends of the power brush and grooming brush arrangements, the location of the wheels relative to the brush arrangements enabling the brush arrangements to brush out all wheel marks on the surface being cleaned regardless of whether the vacuum cleaner is manipulated forwardly or rearwardly.

Preferably, two grooming brushes are each inclined to the power brush at an angle in the range 5 to 20 degrees.

Advantageously, there may be two freely rotatable grooming brushes equally but oppositely inclined to the power brush at an angle of 10 degrees, the grooming brushes being rotated by the forward and rearward manipulation of the vacuum cleaner over the surface being cleaned.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters indicate like parts:

FIG. 6 is a simplified perspective view showing the underside of the vacuum cleaner but with the grooming brushes in a modified disposition;

FIG. 7 is a diagrammatic simplified vertical section through the forward portion of the base of the vacuum cleaner of FIG. 1;

FIG. 8 is a diagrammatic simplified bottom plan view of the same forward portion as shown in FIG. 7;

FIG. 9 is a wiring schematic of the vacuum cleaner of FIG. 1;

DETAILED DESCRIPTION OF THE PREFERRED EMBODIMENT

Figure 11:
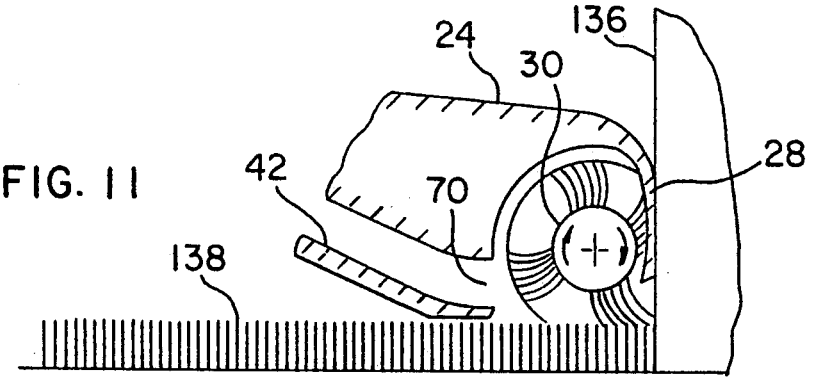
FIG.11 is a diagrammatic simplified vertical section similar to FIG. 7 (but from the opposite side) of a preferred modification to facilitate edge cleaning next to a wall.
Figure 13:
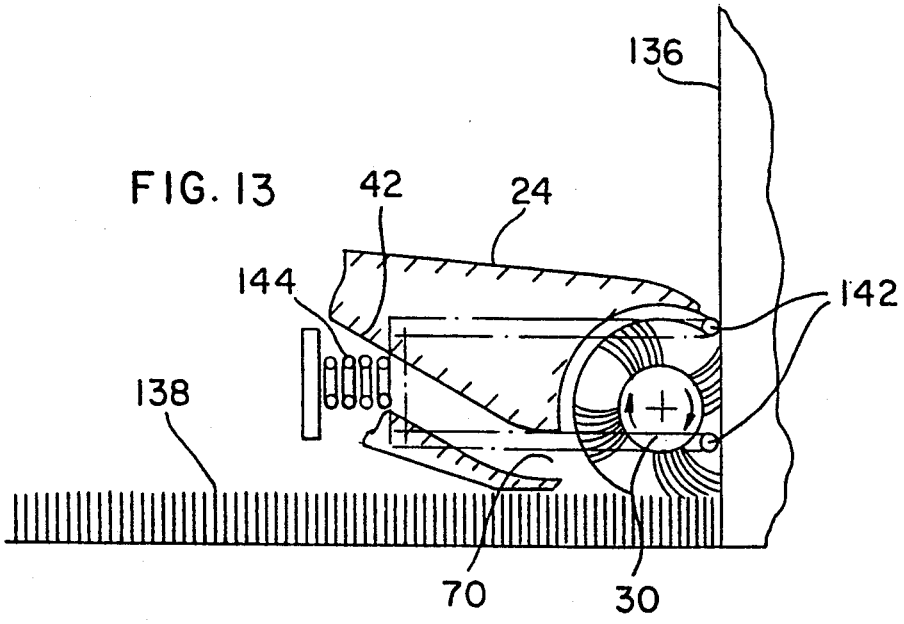
FIG.13 is a section similar to FIGS. 11 and 12 of yet a further modification for edge cleaning.
Figure 12:
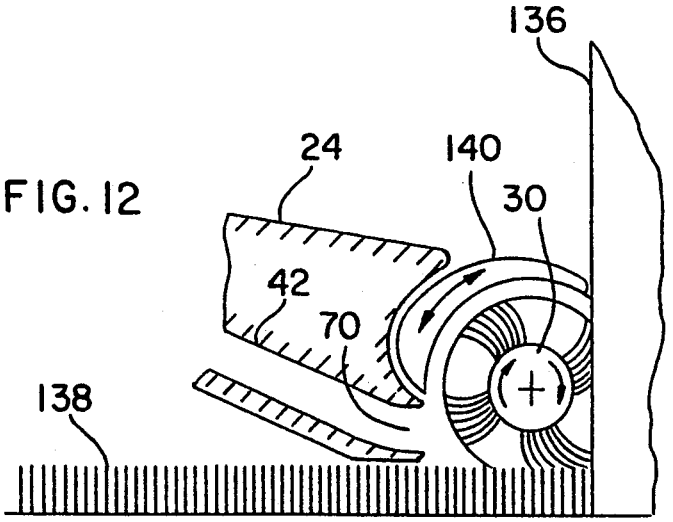
FIG. 12 is a section similar to FIG. 11 of another modification for edge cleaning.

The preferred embodiment of the invention is illustrated mainly in FIGS. 1 to 9 with FIG. 6 showing a grooming brush modification. FIGS. 11, 12 and 13 show three modifications of the front of the base for edge cleaning, the modification of FIG. 11 being the preferred embodiment.

The preferred embodiment is a cordless upright vacuum cleaner which is powered by a rechargeable battery. The advantage of a battery powered cleaner is the absence of a power cord which limits maneuverability, freedom of use, and operating area. However, upright vacuum cleaners, to perform satisfactorily, have traditionally required considerable power of a level which has made operation via cord from house mains electrical supply necessary. The cordless vacuum cleaner of FIGS. 1 to 9 has been specially developed to operate off a reasonably compact battery source and yet provide a carpet cleaning performance compatible with existing mains operated, corded upright vacuum cleaners. It achieves this performance while consuming considerably less power than conventional corded upright vacuum cleaners.

Although all the features of the preferred embodiment combine to provide a superior cordless upright vacuum cleaner, several of the features both individually and in different combinations are advantageously applicable to other kinds of vacuum cleaners to improve the performance and/or reduce the power requirements thereof.

Figure 1:
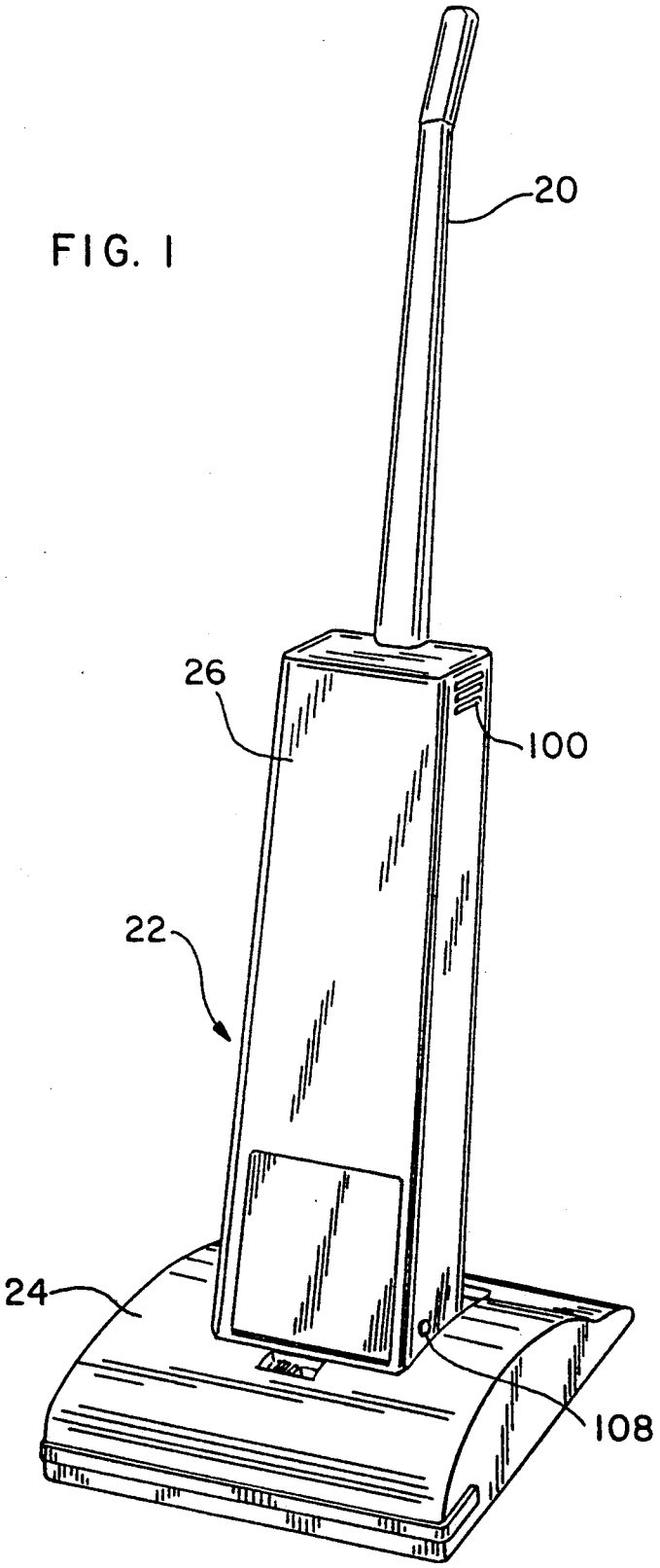
FIG. 1 is a perspective view of a cordless full performance upright vacuum cleaner according to the invention.

FIG. 1 shows a front perspective view of the cordless vacuum cleaner according to the invention which has an upwardly and rearwardly extending handle 20 and a body 22. The body 22 comprises a base 24 and a dust compartment casing 26 pivotally connected to and extending upwards from a central portion of the base 24. The handle 20 is rigidly secured to the top of casing 26 and extends upwardly therefrom.

Figure 2:
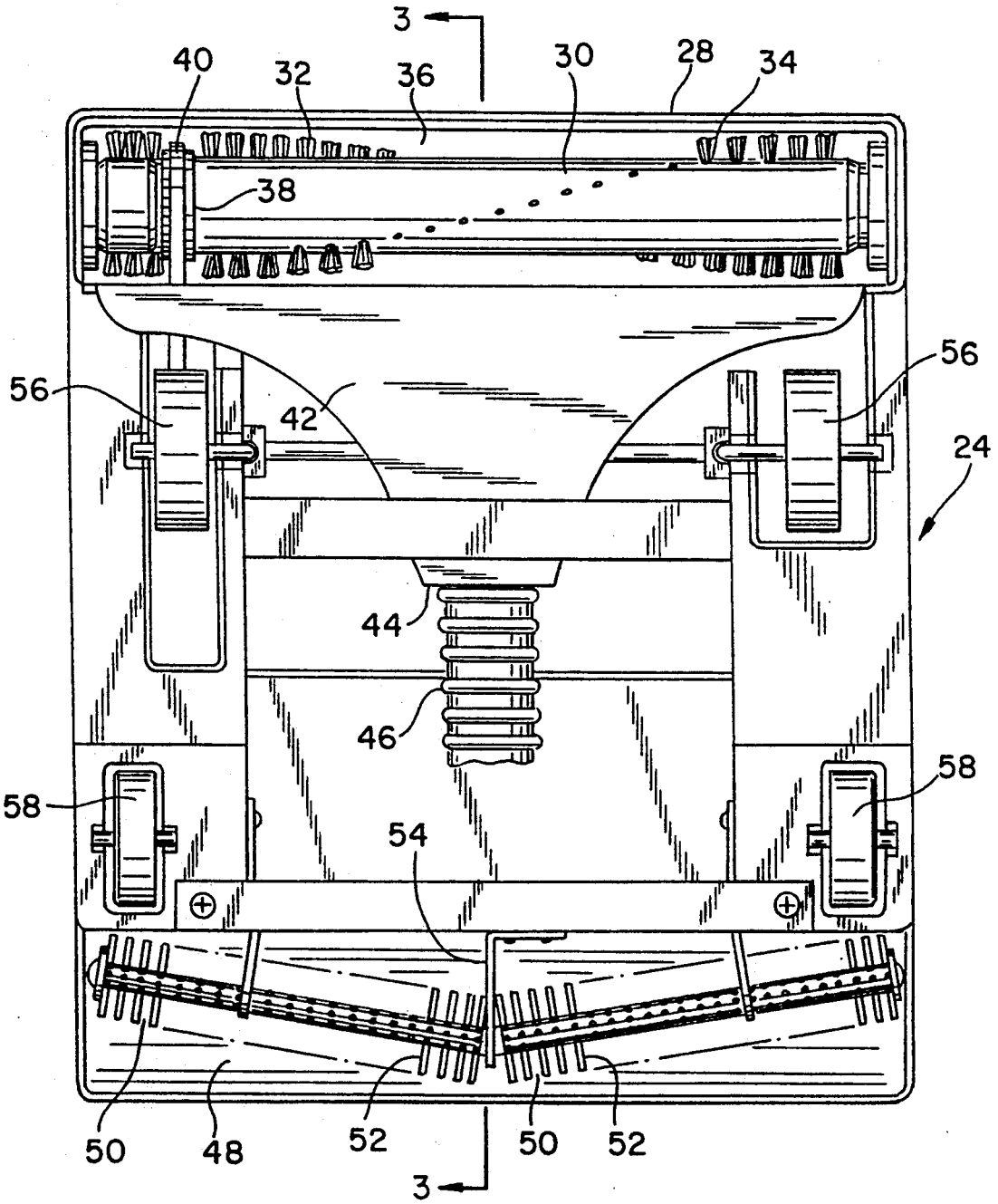
FIG. 2 is an underneath view of the vacuum cleaner of FIG. 1.

FIG. 2 illustrates, in somewhat simplified fashion, the underneath of this vacuum cleaner. The base 24 has a front wall 28; rearwardly of, and immediately adjacent to, this wall 28 is located a power brush 30 rotatable about a horizontal axis. The brush has at least two helically curved rows of bristles 32, 34. The brush 30 extends substantially the full width of the base 24 and is rotatable mounted in a front brush cavity 36. A belt pulley 38 is rigidly mounted on the brush 30 near one end, the pulley 38 passing through the bristle rows 32, 34. A belt 40, passes around and drives the pulley 38. However, it is preferred to locate this pulley at one extreme end of the power brush arrangement.

Rearward of the brush 30, and communicating with the rear of the brush cavity 36, is a vacuum nozzle 42. The nozzle 42 has an inlet which extends transversely across the base 24 for the length of the brush 30. The nozzle 42 rapidly decreases in width rearwardly and is connected at its narrower rear end 44 to a flexible tube 46.

A grooming brush cavity 48 at the rear end of the base 24 contains a pair of grooming brushes 50. The grooming brushes 50 are oppositely inclined to the axis of rotation of the power brush 30 at an angle of about 10 degrees. Together the grooming brushes 50 extend the full width of the base 24, with each brush 50 inclined rearwardly towards the center of the cavity 48, i.e. the two grooming brushes 50 form a shallow V pointing rearwardly. Each grooming brush 50 has a multitude of radially extending bristle tufts 52. The brushes 50 are freely rotatable about their respectively inclined central axes, with their inner ends rotatably mounted in a central bracket 54.

The base is supported and rolls on two pairs of freely rotatable wheels 56, 58. The front pair of wheels 56 are disposed just rearward of the power brush 30, and the rear pair of wheels 58 are disposed just forwardly of the grooming brush arrangement 50. Thus, the wheels 56, 58 are disposed between the power brush and grooming brush arrangements in the forward and rearward direction of movement of the vacuum cleaner. Also, the support wheels 56, 58 are all disposed transversely inwards of the transversely outermost ends of the power brush 30 and the grooming brushes 50. During pushing and pulling movements of the base 24 over a cut-pile carpet, the support wheels 56, 58 will make wheel marks or wheel tracks in the pile of the carpet. However, regardless of whether the base 24 is being moved in the forward or the rearward direction, the rear grooming brushes 50 or the front power brush 30, respectively, will automatically brush out any such wheel marks leaving the carpet uniformly groomed. The grooming brushes are not power rotated, but rotate due to their inclined disposition; forward or rearward movement of the base 24 causes both grooming brushes to rotate by engagement of their bristle tufts 52 with the carpet being cleaned; the inclined arrangement of each grooming brush 50 causes each brush to effect a sweeping action on the carpet (as opposed to a simple rolling action). In this way, the grooming brushes 50 positively sweep the carpet without being power driven (except by the backward and forward movement of the vacuum cleaner). The angle of inclination of the grooming rollers is chosen to provide an effective sweeping action without offering too much resistance to forward and rearward manual manipulation of the vacuum cleaner. An angle to the transverse direction (i.e. to the axes of the power brush 30 and the wheels 56, 58) in the range 5 to 20 degrees has been found satisfactory, with 10 degrees being a good compromise between effective sweeping and low movement resistance.

Figure 3:
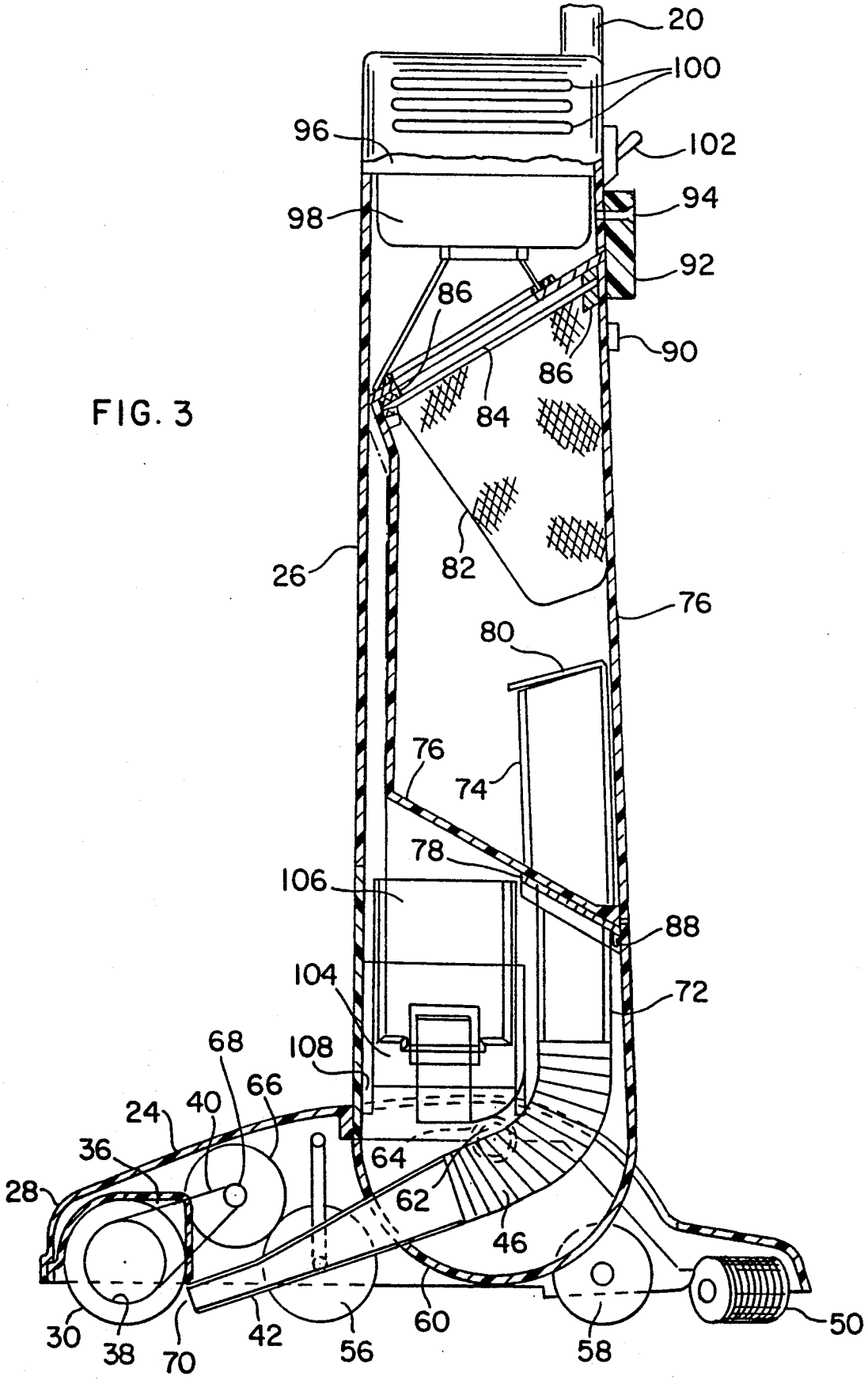
FIG. 3 is a vertical section of the vacuum cleaner on the line 3—3 of FIG. 2 but orientated upright as in FIG. 1.
Figure 5:
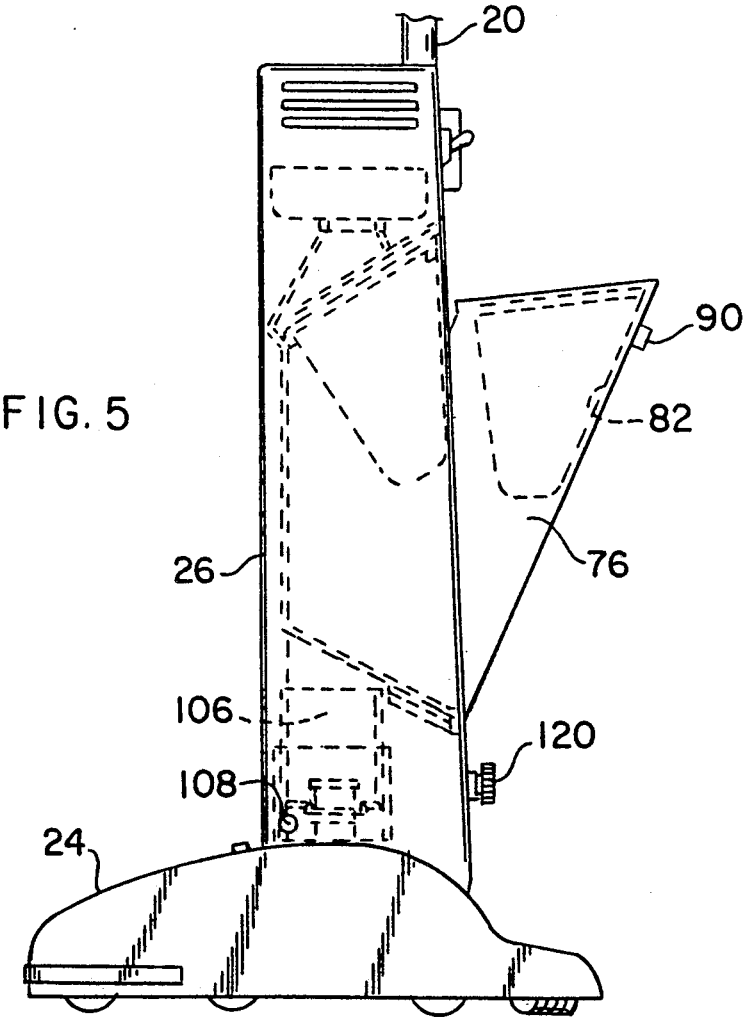
FIG. 5 is a side view of the vacuum cleaner of FIG. 1 showing the dust container, with associated dust filter, pivoted rearwardly for access thereto.

FIG. 3 is a vertical sectional view, again somewhat simplified for ease of understanding. The lower end 60 of the casing 26 is of semi-circular shape and has a coaxial pivot pin 62 on each side journalled in a socket 64 formed in the base 24. An electric motor 66 is housed in the forward portion of the base 24 and has a drive pulley 68 over which engages the belt 38 to rotate the power brush 30. The vacuum nozzle 42 has a single inlet 70 communicating with the front brush cavity 36 at the lower edge of the rear thereof. As can be seen, the inlet 70 is spaced just behind the brush 30 with the nozzle 42 extending rearwardly from the brush 30 substantially tangential thereto. The nozzle 42 so extends rearwardly at an upward inclination through an opening in the casing lower end 60 to its connection inside the casing 26 with the flexible tube 46. The flexible tube 46 turns upwards and is connected to a short tubular pipe 72 securely supported in the casing 26. The flexible tube 46 flexes to accommodate pivotal movement of the casing relative to the base 24 about the pivots 62. The upper end of the short pipe 72 communicates with an inlet duct 74 extending inside a dust container 76. A resilient gasket 78 seals the inlet of the inlet duct 74 against the discharge end of the pipe 72. An upwardly pivoting flap valve 80 is biased downwardly to normally close the discharge end of the inlet duct 74. A filter bag 82, pervious to air but impervious to dust, is disposed in and across the top of the dust container 76. The upper wider end of the filter bag 82 is formed with a supporting frame 84 and is removably sealed in place by peripheral gaskets 86. The lower rear edge of the dust container has downwardly extending projections 88 which removably engage in sockets in the casing 26 to allow pivoting of the dust container 76 rearwardly out of the casing 26 (as shown in FIG. 5). A handle 90 is provided adjacent the upper edge of the rear wall of the container 76 to be grasped by an operator to effect this pivoting. A manually pivotal latch 92 normally retains the dust container 76 in position as shown in FIG. 3, but upward pivoting of the latch 92 about its pivot 94 releases the container 76 for rearward pivoting. The upper edge of the container 76 in inclined forwardly and downwardly relative to the casing 26, this enabling this upper edge to assume a substantially horizontal disposition when the dust container 76 is pivoted rearwardly to a full open position as shown in FIG. 5. An electric motor 96 and fan 98 driven thereby are mounted as a unit at the top of the casing 26 just above the dust filter 82. The fan 98 sucks air in through the nozzle inlet 70, through the nozzle 42, flexible tube 46, pipe 72, duct 74, flap valve 80, container 76, and dust bag 82, and then discharges the air through exhaust vents 100 at the top of the sides of the casing 26.

Any dust, dirt or other debris entrained in the air sucked in through the nozzle 42 is separated from the air stream in the dust container 76 and collects in the bottom of the container 76. Some dust, lint etc. may adhere to the convex surface of the filter 82 requiring cleaning or replacement of the filter from time to time.

A manually operated switch 102 simultaneously switches both motors 66 and 96 on or off. A battery compartment 104 is disposed in a front portion of the casing 26 below the dust container 76 and above the base 24. A rechargeable battery 106 is located in the battery compartment 104 which is forwardly pivotal about a pivotal axis 108 to provide access to the battery as shown in FIG. 4.

Figure 4:
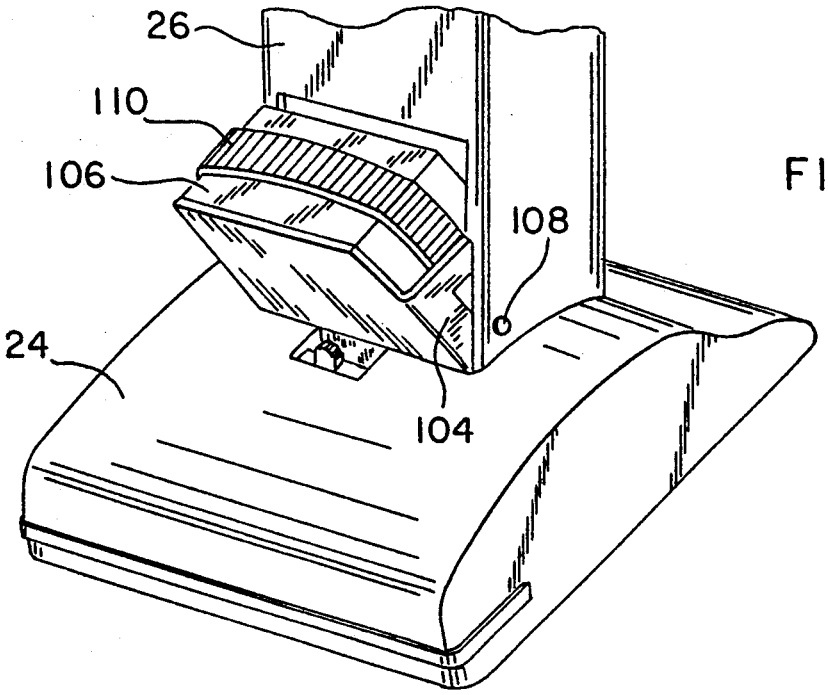
FIG. 4 is a perspective view of the lower portion of the vacuum cleaner of FIG. 1 illustrating access to the battery in a pivotal battery compartment.

FIG. 4 shows the battery compartment 104 pivoted forwardly to expose the battery 106 for inspection or removal, a strap 110 being provided on the battery 106 to facilitate lifting the battery 106 out of its compartment and handling the battery generally. The battery is arranged to automatically plug into the electric circuitry of the vacuum cleaner upon being dropped fully into the compartment 104; likewise, the battery is automatically disconnected when lifted out of the compartment 104. A suitable rechargeable battery is a 12 volt lead acid battery. Preferably, the battery is removed from the vacuum cleaner for recharging; however, a recharging unit could be incorporated in the vacuum cleaner if desired, such unit needing to be temporarily connected by a cord to an electrical outlet while recharging is being performed.

FIG. 5 shows the dust container 76 pivoted rearwardly to provide access to the dust filter 82. In this position the filter 82 can be lifted out and the inside dust container 76 visually inspected. If the container 76 needs emptying, it can be lifted out by pulling it upwardly and slightly rearwardly, the projections 88 (FIG. 3) lifting free of their sockets and enabling complete removal of the container, the container being inverted to empty it. The filter 76 can at the same time be cleaned. The filter is then placed in the container, the container projections 88 (FIG. 3) located into their sockets, and the container pivoted forwardly to its operative position as in FIG. 3.

A push knob 120 at the rear of the casing 26 near the bottom thereof is manually pushed forward to pivot the battery 106 and its compartment forwardly to the position in FIG. 4. The weight of the battery 106, all rearwardly of the pivotal axis 108, when the battery compartment is closed, normally retains the battery compartment in its closed operative position. However, to ensure this compartment remains closed in general handling of the vacuum cleaner, it is preferred to have any suitable type of latch arrangement positively latching it closed.

FIG. 9 is an electrical schematic diagram showing the brush motor 66 connected in parallel with the fan motor 96 across the rechargeable battery 106. The on/off switch 102 is connected between the positive terminal of the battery 106 and both motors 66, 96 to simultaneously connect or disconnect power to both motors.

FIG. 6 is a simplified perspective view of the underside of the base 24. The support wheels 56, 58 can be seen fully inboard of the power brush 30 and the grooming brush arrangement 50. The inlet 70 of the vacuum nozzle 42 can be seen extending the whole length of the power brush parallel thereto but spaced rearwardly by a distance D from the central vertical plane of the power brush 30 (i.e. the vertical plane passing through and containing the axis of rotation of the brush 30).

FIGS. 7 and 8 are a diagrammatic illustrations of the relationship between the power brush 30 and the vacuum nozzle 42, and of the shape of the nozzle 42. The power brush 30 is rotated in the direction of the arrow 122 in FIG. 7 so that it sweeps rearwardly directly towards the nozzle inlet 70. Dirt, dust etc. being swept from a carpet C by the bristle row 34 is projected from the brush 30 along the direction of the arrow 124 directly into and through the nozzle inlet 70. The kinetic energy imparted by the rotating brush 30 to the dirt and other debris causes this material to be projected not only through the nozzle inlet 70 but some distance along the nozzle 42 as indicated by the extent of the arrow 124. As can be seen, the arrow 124 is substantially tangential to the rotating brush 30 and at least the initial portion of the nozzle 42 is aligned with this tangential direction. In this way, not only is the dirt projected mechanically partway up the nozzle 42, but the nozzle does not cause the dirt to change direction as viewed in FIG. 7 (although it may as viewed in FIG. 8) during this projected movement. This helps provide good penetration of the dirt up the nozzle by the kinetic energy imported to the dirt by the brush 30. It should be particularly noted that no, or relatively little, air flow is needed to transport the dirt into and through the initial portion of the nozzle 42. It should also be noted that the direction of the arrow 124, and so the nozzle 42, is inclined upwardly (in the rearward direction) to the carpet C at an acute angle y, of about 20 degrees. Angle y is preferably 20 degrees or less, particularly for any initial portion of the nozzle 42 through which the air velocity is 1,500 feet per minute (457 meters per minute) or less. Further, the distance D between the central vertical plane 126 of the brush 30 and the vertical plane 128 through the nozzle inlet 70 is also a factor affecting maximum projection of the dust particles up the nozzle 42 by the bristles 34, as will be explained later with reference to FIG. 10.

As FIG. 8 illustrates, the nozzle inlet 70 extends along the full length of the brush 30, so that dust particles etc. are, in underneath plan view, projected in straight lines rearwardly into the nozzle inlet 70 along the full length of the row of bristles 34 (as each bristle tuft in the row moves to a position opposite the nozzle inlet 70). The arrows 130 indicate the parallel directions in which all dust particles, etc. are projected by the brush bristles into the nozzle inlet 70.

As can be seen in FIGS. 8 and 2, in plan view the vacuum nozzle 42 reduces in width from its inlet 70 to the flexible tube 46. As can be seen in FIGS. 7 and 3, the vacuum nozzle 42 increases in its height dimension (i.e. the dimension in a transverse plane at right angles to the nozzle's rearward length) as it extends rearwardly from its inlet to the flexible tube 46. This increase in height dimension is arranged so that the cross-sectional area of the vacuum nozzle remains constant (after an initial section) and is substantially equal to the cross-sectional area of the flexible tube 46, the pipe 72 and the duct 74. In this way, the speed of the air drawn by the fan 98 through the air passageway comprising the nozzle 42, tube 46, pipe 72 and duct 74 remains substantially constant. By arranging for the vacuum air to keep a substantially constant speed, the power requirements of the fan 98 can be reduced.

As the nozzle 42 has its greatest width at its inlet 70, it will also have its smallest height at this location. It has been found that the height at the inlet 70 can become too small to allow larger pieces of debris to readily enter the nozzle 42. For examples, larger debris such as cigarette ends, small stones, chips of wood, etc. need to be readily picked up when vacuuming. For this purpose, it has been found necessary to increase the height of the nozzle inlet 70. As can seen in FIG. 7, the initial section 132 of the nozzle 42 is maintained constant in height dimension so increasing the nozzle cross-sectional area along said section 132 in the forward direction (i.e. in the direction opposite to the arrow 124). In this way, the height of the nozzle inlet 70 is increased, but so is the cross-sectional area of this inlet. If the initial section 132 is kept fairly short in length, and the cross-sectional area of the inlet 70 kept to no more than about four times the constant cross-sectional area of the remainder of the nozzle 42 after the initial section 132, it has been found that good cleaning performance is still maintained and larger pieces of debris are readily picked up and pass through the nozzle inlet. It is believed that the mechanical projection of dirt etc. by the rotating brush 30 through the initial section 132 (as illustrated by the arrow 124) is a major factor in enabling good performance to be achieved even though the air speed through the nozzle initial section 132 is lowered by the increase in cross-sectional area at that location.

In the initial part of the nozzle 42, it has been found that the shape of the side walls of the nozzle (as viewed in FIG. 8) is critical where the air velocity is less than 1,000 feet per minute (305 meters per minute). In FIG. 8, due to the constant height dimension of the initial section 132 (FIG. 7) of the nozzle, the first portion up to a distance G from the inlet 70 has flowing through it in use air at such a velocity, when the air velocity through the downstream section of the nozzle and the tube 46 is about 2000 feet per minute (610 meters per minute). The shape or curvature of the nozzle side walls over this distance G should make an angle x with the sides of the base 24 (which sides are parallel to the arrows 130) which is not greater than 45 degrees, and is preferably less than 45 degrees. This is to prevent the dirt particles etc. having any tendency to bounce out of the nozzle inlet 70 upon striking the nozzle side walls when the air velocity is low. At higher air velocity, the situation is more forgiving and dirt particles etc. rebounding from the nozzle side walls are carried by the higher velocity air along in the air stream. The distance G is preferably kept to about 1.2 inches (3 cm) or less. As can be seen in FIG. 8, in the downstream part of the nozzle 42 after the distance G, at places the nozzle side walls are more sharply inwardly curved and have an angle x which is greater than 45 degrees; however, at these places the air velocity is at or approaching 2000 feet per minute (610 meters per minute).

Figure 10:
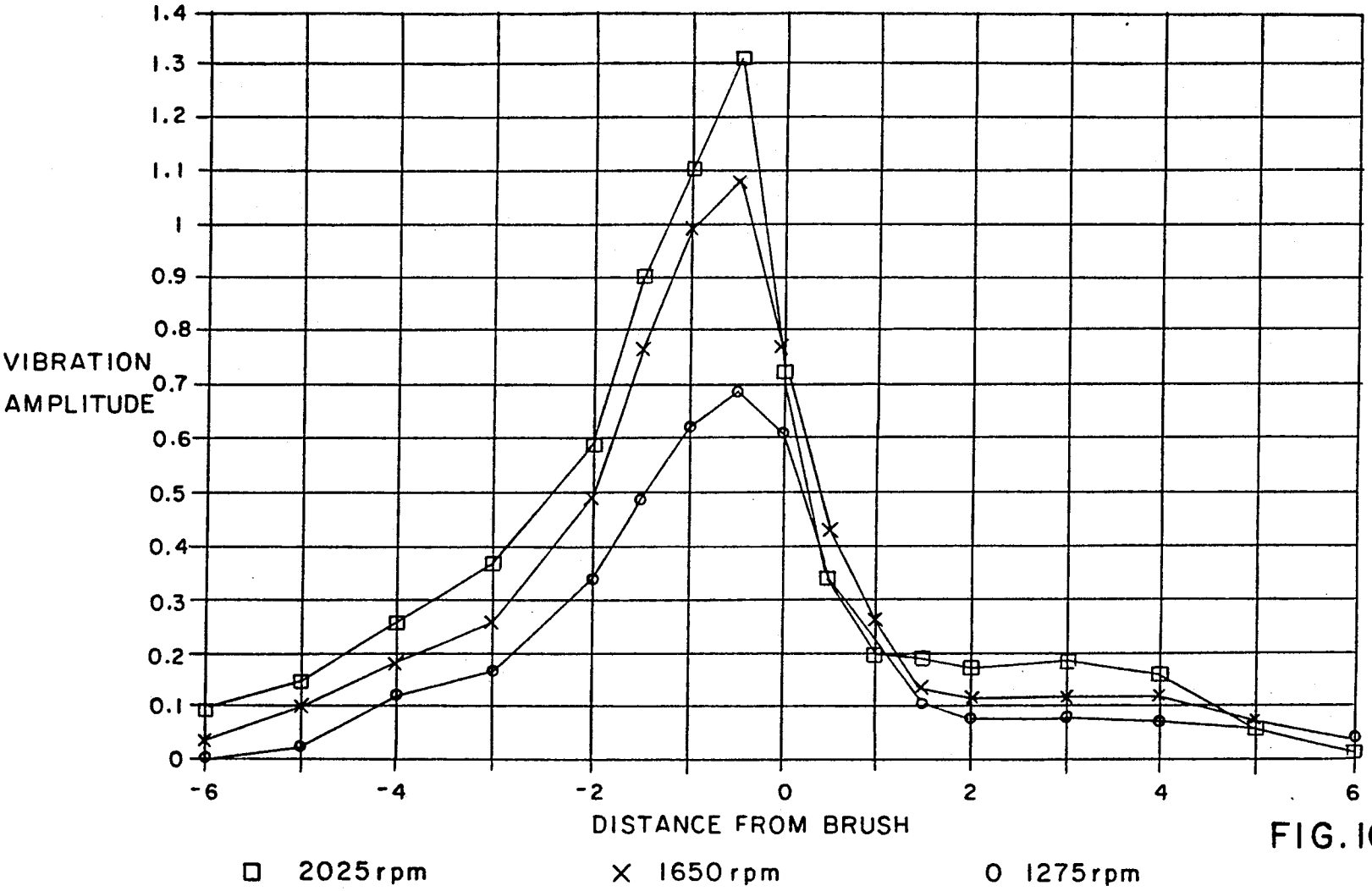
FIG.10 is a graph illustrating how vibration amplitude of the carpet changes with distance from the power driven brush, and shows the position of theoretical location of maximum amplitude.

When a brush is power rotated on a carpet, it has been noticed that the carpet is vibrated in the area of the brush. With an all bristle brush such as the brush 30, this is probably accentuated by separate rows of bristles 32, 34 successively impacting upon the carpet even through each row is helically disposed. The amplitude of these vibrations at different distances from the brush and at different brush speeds were investigated. FIG. 10 illustrates the results of the investigation. The vibration amplitude was determined by measuring the movement of grit (e.g. sand) on the carpet while being vibrated by rotation of the brush 30 at a stationary location.

FIG. 10 shows three curves obtained by plotting vibration amplitude numbers against distance from the line of contact of the rotating brush with the carpet. The vibration amplitude numbers are readings of a measurement instrument and not directly representing inches or centimeters. The three curves represent brush speeds of 2025 rpm, 1650 rpm, and 1275 rpm. The 2025 rpm curve is plotted with squares, the 1650 rpm curve with crosses, and the 1275 rpm curve with circles. All three curves show poor vibration amplitude forwardly of the brush (the positive distance numbers). All three curves show a peak vibration amplitude at approximately the same location of 0.5 inch (1.3 cm) rearwardly of the brush contact line, with the 2025 rpm curve peaking the highest.

This suggests that to impart maximum vibration amplitude to the dirt particles, the nozzle inlet 70 should be located 0.5 inch (1.3 cm) rearward of the contact line of the roller 30 with the carpet, i.e. in FIG. 7 the distance D should be 0.5 inch (1.3 cm). This was tried and then the vibration of particles observed as the nozzle location was varied. Surprisingly it was found that the location in each instance providing the maximum vibration amplitude was at about 1.2 inches (3 cm) rearward of the brush contact line, that is, maximum vibration amplitude was achieved at D equals 1.2 inches (3 cm). It has been found, therefore, that if the peak vibration amplitude given by the curves of FIG. 10 is called the theoretical location of maximum amplitude of carpet vibrations, the nozzle inlet should be spaced rearwardly from this theoretical location. The nozzle inlet should preferably be spaced two to three times the distance from the brush as the theoretical location of maximum amplitude.

With such rearward spacing of the nozzle inlet for actual maximum vibration amplitude, maximum kinetic energy due to carpet vibration is transmitted to the dust particles. This kinetic energy generally tends to increase the kinetic energy directly imparted to the dust particles by the brush bristles, and so aids the speed and distance many of the particles travel along the arrow 124 in FIG. 7. This in turn enables less air flow to be used to pick up the dust particles. An air speed of 2000 feet per minute (610 meters per minute) or higher is desirable for conveying dust particles etc. in a suspended state. As the fan power required increases with the cube power of the volume of air being displaced, for lowest fan power consumption the minimum volume of air should desirably be conveyed at 2000 feet per minute (610 meters per minute).

With the embodiment of FIGS. 1 to 9, a highly efficient upright vacuum cleaner was created with a power brush speed of 2,000 rpm and a fan created maximum air flow of 28 cubic feet per minute (0.8 cubic meters per minute). The power consumption of the fan was 50 Watts and the power consumption of the power brush 95 Watts, giving a total power consumption of 145 Watts. When tested against a leading consumer mains powered upright vacuum cleaner, the vacuum cleaner of the present invention had a generally comparable performance with regard to both overall cleaning and pick-up of grit and embedded dirt, while using only about 20 percent of the input power of the mains unit.

The present invention has made it possible for a cordless upright vacuum cleaner to effectively compete performance-wise with mains powered corded upright vacuum cleaners. Further, with the low power consumption facilitated by the present invention, a battery powered cordless vacuum cleaner as described can operate for sufficient time to vacuum several rooms before requiring recharging.

FIGS. 11 to 13 illustrate modifications to the front of the base 24 to enable edge cleaning to be performed at the front of the vacuum cleaner—particularly without the need to increase air flow or power consumption.

In FIG. 11 the front wall 28 is made resiliently flexible and is at the top integrally or separately attached to the base 24. The front wall 28 extends down in front of the brush 30 as a skirt which in normal use is spaced a small distance from the surface of the rotating brush 30.

When the base 24 is pushed forwardly against the bottom of a wall 136 (or the like), the thin front wall 28 flexes rearwardly and engages against the surface of the brush 30. This causes the brush bristles to be deformed against the inside surface of the flexed wall 28, but enables these bristles to spring forward beyond the front wall 28 as the bristles pass from the restraining effect of the wall 28 to the edge of the carpet 138 below. In this way, the bristles sweep down the lowest part of the wall 136 and then rearwardly through the carpet 138 at its junction with the bottom of the wall 136. Thus, the dirt, etc. at the junction between the carpet and the wall is projected rearwardly by the brush bristles into and along the vacuum nozzle 42 without requiring additional air flow.

FIG. 12 illustrates another embodiment in which the front wall 28 is replaced by an arcuate cover 140 mounted in the base 24 for pivotal movement about the rotational axis of the power brush 30. The cover 140 is resiliently biased to pivot forwardly, i.e. clockwise in FIG. 12, so that it normally extends over the front of the brush 30 in the same manner as the front wall 28 in FIGS. 2 and 3. However, upon being pushed against the bottom of the wall 136, the cover 140 retracts into the base 24, against its resilient bias, to the retracted pivotal position shown in FIG. 12. In this position, the brush bristles sweep down the lowest part of the wall 136 and, as in the embodiment of FIG. 11, effectively clean the edge of the carpet 138 without requiring additional air flow.

FIG. 13 illustrates a third embodiment for front edge cleaning in which a front guard 142 is resiliently urged to a forward extended position by an adjustable spring 144. This embodiment functions similarly to the above embodiments for edge cleaning.

As will be appreciated, the present invention is applicable to power brush vacuum cleaners in general, however powered, to improve their performance and/or reduce their power consumption. However, it will be realized that the present invention represents a major advance in cordless upright vacuum cleaners.

As will now be appreciated, the preferred embodiments of the present invention, in its various aspects, provide efficient air flow with minimum air consumption, reduced power consumption but with effective cleaning performance, improved carpet grooming, and improved front edge cleaning.

The above described embodiments, of course, are not to be construed as limiting the breadth of the present invention. Modifications, and other alternative constructions, will be apparent which are within the spirit and scope of the invention as defined in the appended claims.

What is claimed is:

1. A cordless vacuum cleaner, comprising:

a handle connected to a body for pushing said body in a forward direction over a surface to be cleaned and for pulling said body in a rearward direction over said surface;

said body containing a power driven brush rotatable about an axis parallel to the surface to be cleaned;

vacuum nozzle located adjacent said brush;

said brush being disposed immediately adjacent but rearwardly of, a front wall of said body; and said front wall being resiliently yieldable rearwardly when said body is pressed forwardly against a room wall to enable said brush to contact and sweep the surface to be cleaned at an edge location thereof abutting said room wall.

2. The cordless vacuum cleaner of claim 1, including:

means for rotating said brush to sweep said surface in said rearward direction; and said front wall being pushed rearwardly into contact with a front portion of said brush when said body is pressed forwardly against said room wall, said rotating means causing a lower front portion of said brush to sweep downwardly against and away from said room wall.

3. The cordless vacuum cleaner of claim 2, wherein said front wall comprises a deformable skirt attached along an upper edge to said body and having a free lower edge.

4. The cordless vacuum cleaner of claim 3, wherein said skirt, when not being deformed, is spaced from said brush.

5. The vacuum cleaner of claim 1, further comprising a battery supported by said body and electrically connectable to means for rotatably driving said brush.

6. The vacuum cleaner of claim 1, wherein said front wall comprises a movable element which is biased to normally extend forwardly over said brush, but on being pressed forwardly against the room wall retracts relative to said body to expose said brush to the room wall.

7. The vacuum cleaner of claim 6, wherein said element moves pivotally about said brush axis.

8. The vacuum cleaner of claim 1, wherein said nozzle is located rearward of, adjacent and facing towards said brush, said brush is rotatably driven to sweep downwardly against the room wall towards the surface to be cleaned, and said brush sweeps dirt from said surface rearwardly directly into said nozzle.

9. A vacuum cleaner, comprising:

a body containing a power driven brush having bristles;

means, connected to said body, for pushing said body forwardly and pulling said body rearwardly over a surface to be cleaned;

said body having a front wall which is normally spaced from and extends downwardly over a front portion of said brush; and said front wall being resiliently yieldable rearwardly relative to said body when said body is pushed forwardly against a room wall to expose said brush at a junction of said wall with said surface and enable said bristles to sweep said junction to remove dirt therefrom.

10. The vacuum cleaner of claim 9, wherein upon rearward yielding of said front wall said bristles contact and sweep down a bottom part of said room wall at said junction.

11. The vacuum cleaner of claim 9, wherein said front wall is retractable into said body.

12. The vacuum cleaner of claim 9, wherein said front wall comprises a deformable skirt which contacts and presses against said bristles when said front wall yields rearwardly relative to said body.

13. Apparatus for use in vacuum cleaning a surface, comprising:

a body containing a power driven brush;

a handle connected to said body for pushing said body forwardly and pulling said body rearwardly over said surface;

said body having a front wall which is normally spaced from and extends over a front portion of said brush; and said front wall being resiliently yieldable rearwardly relative to said brush when said front wall is pushed forwardly against a room wall to enable said brush to reach and act upon a junction of said wall with said surface to remove dirt from said junction.

14. The apparatus of claim 13, wherein upon rearward yielding of said front wall said brush contacts and sweeps down a bottom part of said room wall at said junction.

15. The apparatus of claim 13, wherein said front wall is retractable into said body.

16. The apparatus of claim 13, wherein said front wall comprises a deformable skirt which contacts and presses against said brush when said front wall yields rearwardly relative to said brush.

17. The apparatus of claim 13, including an electric motor for driving said brush.

18. The apparatus of claim 13, including a vacuum nozzle adjacent said brush.

19. The apparatus of claim 18, including a fan for sucking air through said vacuum nozzle.

20. The apparatus of claim 13, including an electrically driven fan for applying a vacuum in the vicinity of said brush.

* * * * *